United States Patent [19]

Moisan

[11] Patent Number: 5,044,520

[45] Date of Patent: Sep. 3, 1991

[54] COIN OPERATED COSMETIC DISPENSING MACHINE

[76] Inventor: Hubert Moisan, 4020, boul. Talbot, Stoneham (Québec), Canada, G0A 4P0

[21] Appl. No.: 418,877

[22] Filed: Oct. 10, 1989

[51] Int. Cl.[5] ..... G07F 13/08

[52] U.S. Cl. ..... 222/2; 222/639; 222/136; 222/144.5; 222/192; 222/637; 239/71; 239/305

[58] Field of Search ..... 222/2, 639, 642, 645, 222/646, 136, 144.5, 145; 239/305, 307, 308, 365, 433, 366, 368, 369, 71; 194/351

[56] References Cited

U.S. PATENT DOCUMENTS

| | | | |
|---|---|---|---|
| 1,067,891 | 7/1913 | Wagner | 239/433 |
| 1,504,851 | 8/1924 | Wren | 239/433 |
| 1,805,632 | 5/1931 | Milar | 239/366 |
| 3,310,204 | 6/1965 | Zinman et al. | 239/305 |
| 3,387,692 | 6/1968 | Levake | 222/639 |
| 4,517,651 | 5/1985 | Kawasaki et al. | 222/639 |
| 4,527,713 | 7/1985 | Ingram | 222/2 |
| 4,629,051 | 12/1986 | Abe | 194/351 |
| 4,751,994 | 6/1988 | Brown, Jr. et al. | 239/308 |

*Primary Examiner*—Andres Kashnikow
*Assistant Examiner*—Lesley D. Morris

[57] ABSTRACT

A coin-operated dispenser is disclosed for spraying a liquid cosmetic in a controlled manner. It has the features of a coin-operated, public vending machine, but instead of delivering a pack of cigarette or candies, it delivers a liquid cosmetic under pressurized air through a spray gun which has a trigger. The spray gun is mounted at the end of a flexible tube. A push-button on the machine enables the selection of a desired one of many liquid cosmetic products. A push button switch on the spray gun permits a user to manually control the flow of sprayed cosmetics. A timer limits the time period for each spraying, when the preset coin amount has been introduced in the machine and a display indicates to the user the time remaining for dispensing the product. Accordingly, the user knows precisely how much time is remaining after he releases the trigger, thus permitting sharing of the product by more than one person.

7 Claims, 2 Drawing Sheets

COIN OPERATED COSMETIC DISPENSING MACHINE

FIELD OF THE INVENTION

This invention relates to coin-operated vending machines.

BACKGROUND OF THE INVENTION

Coin-operated machines for delivering cigarette packs, candies, fruits and the like are well known. Guns for spraying a fluid under pressure are also well known: garden sprinklers, sandblasters and the like. However, to the knowledge of applicant, there is no coin-operated machine which enables the public to select a liquid cosmetic product from a vending machine, said liquid cosmetic product being sprayable directly from the machine, e.g. in ladies' and/or men's public washrooms.

OBJECT OF THE INVENTION

The object of the invention is to provide added comfort to the business traveler, by providing a liquid cosmetic sprayer coin-operated vending machine in the public washrooms.

SUMMARY OF THE INVENTION

In accordance with the teachings of the invention, there is disclosed A coin-operated dispensing machine, comprising:

(a) at least one container for a cosmetic liquid;

(b) a compressed air tank;

(c) a first air line, interconnecting said cosmetic container and air tank;

(d) a second air line, interconnecting said air tank to a spray gun;

(e) first electro-valve means, to control airflow in said second line;

(f) a large closed box-like casing, enclosing said container, said tank, said first line and said first valve means;

(g) a third cosmetic liquid line, interconnected said container and said spray gun, whereby both pressurized air from said second line and cosmetic from said third line are destined to be ejected from said spray gun;

(h) manual control means, mounted to said spray gun and destined to enable a user to control said first electro-valve means;

(i) a tamper-proof coin-receiving and processing means, embodied into said large casing and capable of recording the number of coins inserted therethrough into said casing and of correlating said number of coins to a preset coin amount; and (j) second electro-valve means, to control cosmetic flow through said third line; and (k) switch means, to control the opening of both said valve means once the threshold of said preset coin amount has been registered by said processing means.

DETAILED DESCRIPTION OF THE INVENTION

Figure 1:
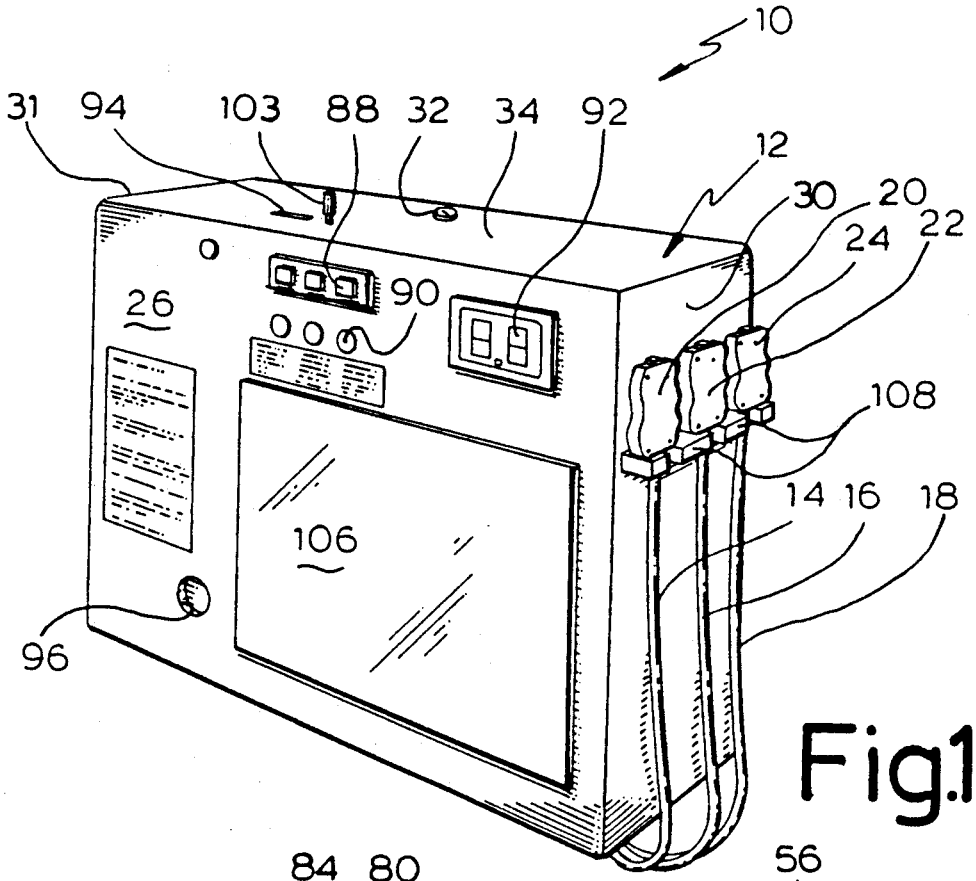
FIG. 1 is a perspective view of the cosmetic dispenser device.
Figure 2:
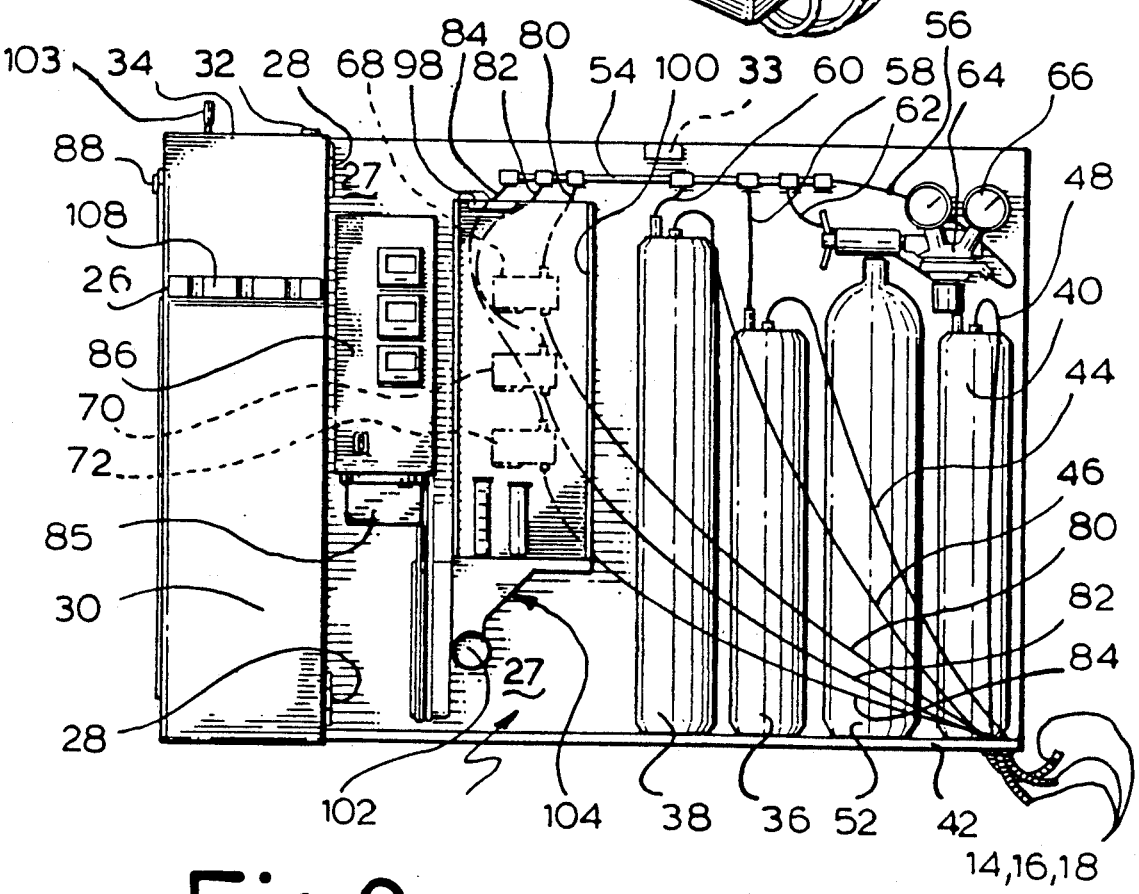
FIG. 2 is a rear elevational view of the dispenser device, showing the rear wall thereof and the box-like cover pivoted by 90° to opened position.

Dispenser device 10 includes a large box-like casing 12 from which projects a number of flexible tubes, e.g. three tubes 14, 16, 18. Each tube 14–18 bears at its outer free end a spray gun, 20, 22, 24 respectively. Casing 12 includes a front wall 26, a rear wall 27, two side walls 30, 31, a top wall 34 and a bottom wall 42. The rear wall 27 is integral to the bottom wall 42, and edgewisely connected to side wall 31 by hinge 28; the front wall 26 is integral to both side walls 30, 31 and to top wall 34. The top wall 34 is releasably anchored to the top edge section of the rear wall 27.

A known lock system, including a locking barrel 32 projecting from top wall 34 and a finger 33 projecting from the top section of rear wall 27, locks the two half sections of the casing 12 together. A restricted-access key, not shown, operates barrel 32.

A number of closed, sealed containers, e.g. three containers 36, 38, 40 corresponding to the number of spray guns 20–24, are mounted into casing 12, e.g. supported by the casing flooring 42.

Each container 36–40 is destined to contain one distinct liquid cosmetic e.g. a perfume. Fluid lines 44, 46, 48 are destined to feed liquid cosmetic from containers 36, 38, 40 to spray guns 22, 24, 20 respectively, through tubes 16, 18, 14. Hence, tubes 14–18 constitute protective sheaths. The cosmetic feed means is detailed below.

A compressed air system including a compressed air tank 52 is provided, to feed compressed air to each cosmetic liquid container 36–40. Tank 52 is preferably supported by flooring 42. A main air line 54 is anchored to the casing rear wall 27, fed with compressed air from air tank 52 via air line 56, and connected to containers 36–40 by fluid lines 58, 60, 62 respectively. An air pressure regulating valve assembly, 64, including control gauges 66, is anchored to tank and operatively mounted to air line 56 to communicate with main air line 54. Electronic air flow control valve members 68, 70, 72 control three air lines 84, 82, 80 respectively, the latter lines operatively extending between main air line 54 and spray guns 20–24 respectively. The valve members 68–72 are anchored to casing 12, e.g. to rear wall 27. An electronic control box 86, anchored to rear wall 27 proximate electro-valves 68–72, is operatively connected to the latter.

A push button panel 88 is installed on the front wall 26, to enable selection of one valve 68–72 via control box 86. Actual opening of the selected electro-valve 68–72 is actuated by a trigger means, detailed later, after one push button 88 has been selected. Pilot lights 90 in register with push buttons 88 indicate which valve has been selected, i.e. the air to be fed to a corresponding nozzle gun 20–24, and, by remaining alighted for the time period when the valve remains opens, also indicate the effective operating time. A window 92 bearing LED or LCD numerical displays is also mounted to front wall 26 and is connected to a suitable clock or timer 85 anchored to rear wall 27 and operatively connected to control box 86. The numerical display of window 92 indicates the total or remaining time the selected electro-valve 68–72 remains open.

Dispenser 10 is intended to be a coin-operated vending machine, i.e. to deliver air and cosmetic to a spray gun 20–24 once money has been paid. Therefore, a coin collecting and dispenser enabling means is provided, these latter means including a coin-intake slot 94, in top wall 34, a coin passageway (not shown) downwardly descending from top wall 34 and in register with slot 94, a coin-receiving and processing means enclosed in a box 100 being mounted to the inner face of rear wall 27 and having an intake slit 98 in register with slot 94.

A predefined coin amount registered by the coin processing means 100 will render the electro-valves 68–72 receptive to said valve-opening trigger means (detailed below). Any coin inserted in slot 94 and exceeding said preselected coin amount will be released from the machine upon pressing a known coin-release button 103, projecting from top wall 34, through coin outlet chute 102, the latter opening into an aperture 96 made in front wall 26.

The coin-processing and dispenser-enabling means 100 is based on conventional makes, for example the coin changer bearing the trademark COIN-CO, model no S75-9800A.

A large mirror 106 may be added to the front wall 26, and brackets 108 for supporting the spray guns 20–24 may be provided to the outer wall of the casing side wall 31.

Figure 4:
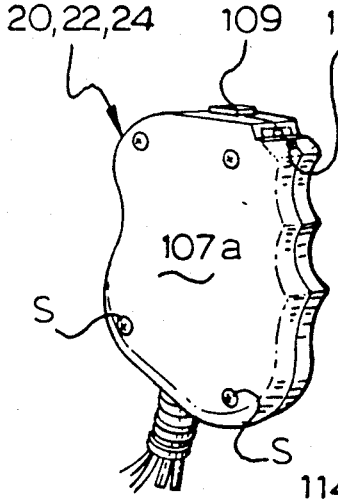
FIG. 4 is a perspective view of one of the cosmetic spray guns of the dispenser device.
Figure 5:
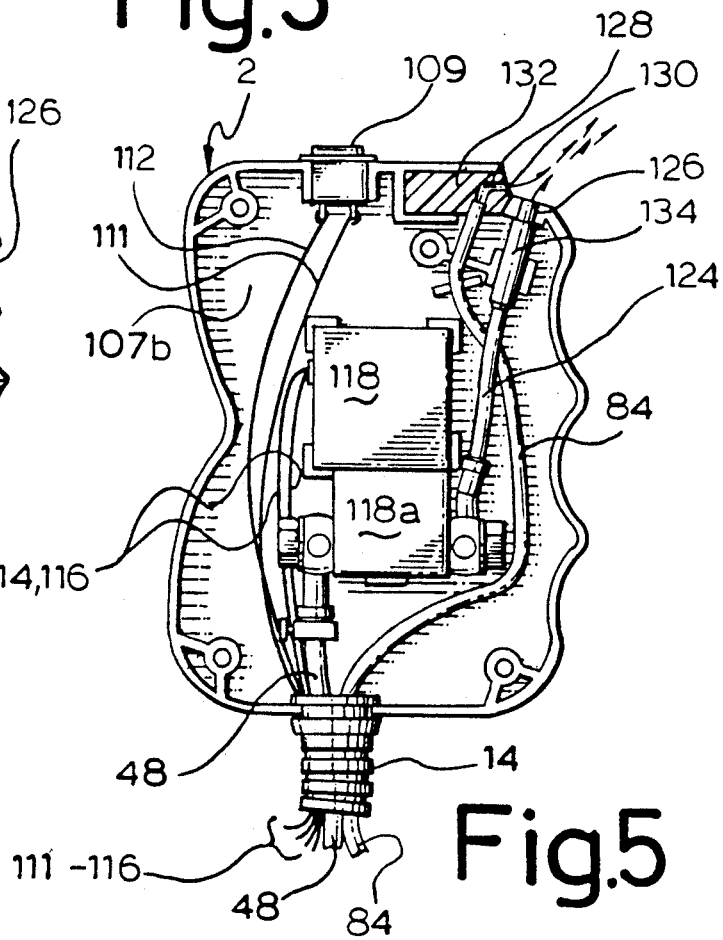
FIG. 5 is a sectional view of the spray gun.

Each spray gun 20–24, shown in FIGS. 4–5, includes two dismanteable plastic housing halves 107*a*, 107*b*, which may be interconnected by screws S. These guns are of a shape facilitating their handling with one hand. A spray-enabling button switch trigger 109 outwardly projects from housing section 107*b* edgewisely thereof. Two first electrical lines, 111, 112 electrically interconnect switch trigger 109 to one of the electro-valves 68–72, through the corresponding sheath tubes 14–18, and two other electrical lines 114, 116 electrically interconnect the same electro-valve 68–72 to a further electro-valve 118 being anchored to housing section 107*b*. Each line 44–48 is connected to the valve section 118*a* of the electro-valve 118 of a corresponding gun 22, 24, 20, respectively.

In the case of gun 20 in FIG. 5, cosmetic line 48 is operatively connected to valve 118*a*, from which exits a further hose 124 opening to the outside of housing 107*b* through a mouth 126. Air line 84 opens into a narrow elbowed channel 128 made thicknesswisely of housing 107*b* proximate mouth 126, the channel 128 defining an outlet port 130. The lengthwise axes of mouth 126 and port 130 are outwardly convergent, thus admixing of cosmetic and pressurized air outside the gun is made possible.

Hence, by pushing (i.e. closing) switch trigger 109, the corresponding one of electro-valves 68–72 is triggered by lines 111–112 to open, so as to enable pressurized air to flow through the corresponding lines 80–84. Moreover, electrovalve 118 is concurrently opened to trigger flow of cosmetic liquid.

Figure 3:
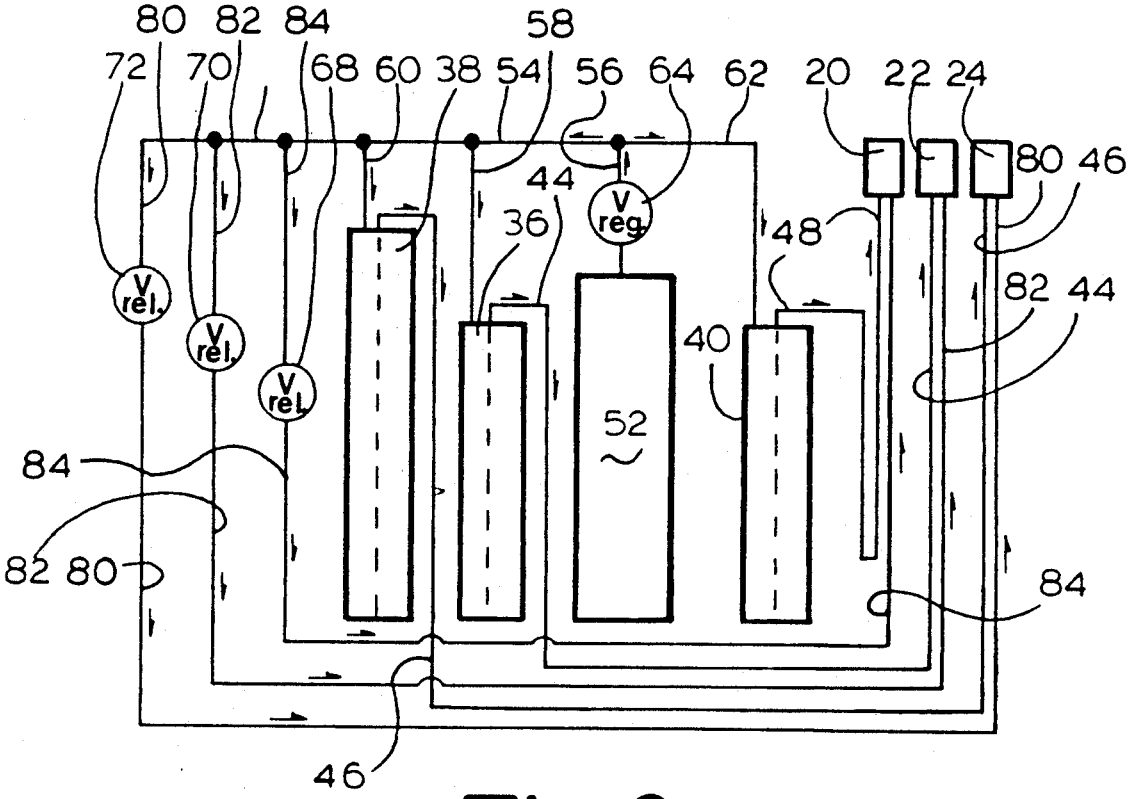
FIG. 3 is a schematic view of the dispenser device.

As is clearly seen from the schematic of FIG. 3, the containers 36–40 are maintained under constant air pressure by the air lines 58–62.

Preferably, channel 128 is made from a small plastic block 132, releasably embedded in both housings 107*a*, 107*b*. Advantageously, a check valve 134 is installed onto cosmetic hose 124: valve 134 contains a spring-loaded ball, not shown, which closes this valve to prevent exit through port 126 of cosmetic liquid, once a predetermined lower limit of liquid pressure has been reached. Preferably, the large casing 12 should be made from a metallic alloy, to prevent tampering by unauthorized personnel when locked with lock 32. Advantageously, air lines 80–84 are nylon-based, while cosmetic lines 44–48 are made from a flexible plastic material.

It is envisioned that the control box include a single microprocessor (CPU), such as model MC 1468 705 G2 of Motorola Corp., to electronically control the present dispenser. This microprocessor could have a ROM (read-only memory) of 1.7 kilobits (kb), and a working memory of e.g. 0.1 kb. In view thereof, a single timer relay for clock 85 within the electrical circuit would be sufficient. The preset time period for the cosmetic spraying period may be set at different values for each of the three cosmetic containers, e.g. twenty, thirty and forty seconds.

Preferably, an electro-magnet is provided about coin-inlet slit 94, to prevent a user from inserting coins thereinto when the machine is operating i.e. delivering cosmetic. The electro-magnet is controlled by the CPU.

The cosmetic products used may be, e.g.: a hair conditioner, a deodorant, a fragrance and the like. It is understood that, since the spray gun is mounted to the end of a flexible tube, a user, e.g. a business person using public washroom facilities provided with the present cosmetic dispenser, may direct the spray gun at his/her own will, toward any part(s) of his/her body, with utmost ease and comfort.

I claim:

1. A coin-operated dispensing machine, comprising:

(a) at least one container for a cosmetic liquid;

(b) a compressed air tank;

(c) a first air line, interconnecting said cosmetic container and air tank;

(d) a second air line, interconnecting said air tank to a spray gun having a trigger for controlled dispensing of said cosmetic liquid;

(e) said trigger controlling a first electro-valve means to control airflow in said second line;

(f) a large closed box-like casing, enclosing said container, said tank, said first line and said first valve means;

(g) a third cosmetic liquid line, interconnected said container and said spray gun, whereby both pressurized air from said second line and cosmetic from said third line are destined to be ejected from said spray gun only when said trigger is depressed;

(h) a tamper-proof coin-receiving and processing means, embodied into said large casing and capable of recording the number of coins inserted therethrough into said casing and of correlating said number of coins to a preset coin amount; and (i) second electro-valve means, to control cosmetic flow through said third line; and (j) switch means, to control the opening of both said valve means once the threshold of said preset coin amount has been registered by said processing means, a central processing unit; a timer means operatively connected to said first and second valve means, to said central processing unit and to said coin-receiving and processing means; said timer means being connected to disengage said first and second valve means once a preset time period has elapsed following the opening of said first and second valve means, a visual time display device mounted on said casing and visible to a user to indicate the opening time available for opening said first and second valve means to dispense said cosmetic liquid, said first and second valve means being opened and closed by the actuation of said trigger so that the user is aware by said time display device how much dispening time remains during a dispensing time period so that said cosmetic liquid can be dispensed in a controlled manner and shared with other users during said dispensing time period, then being at least two of said containers, each having an associated spray gun, each one of said two containers having a different dispensing time period.

2. A dispensing machine as defined in claim 1, wherein an upstream leg of said first and second lines merge, and further including air pressure regulator means, mounted to said merged upstream leg of said first and second lines for controlling air flow through said first and second air lines.

3. A dispensing machine as defined in claim 1, wherein said second and third lines open into said spray gun into first and second spray gun outlet ports, the lengthwise axes of said ports outwardly converging toward each other.

4. A dispensing machine as defined in claim 3, wherein said air line include a narrow elbowed channel at its downstream end.

5. A dispensing machine as defined in claim 4, wherein said elbowed channel is made into a plastic block, the latter being removably mounted into said spray gun.

6. A dispensing machine as defined in claim 1, wherein there are at least two said cosmetic containers each with a different said liquid cosmetic, said liquid cosmetic being chosen from the group including fragrances, deodorants, hair conditioners and the like.

7. A dispenser machine as in claim 1, further including a check valve, mounted to said second air line downstream of said second electrovalve means, said check valve being provided with a spring-loaded ball to close the checkvalve to prevent further ejection of cosmetic liquid once a predetermined lower limit of liquid pressure has been reached.

* * * * *